United States Patent [19]

Fischer

[11] Patent Number: 4,828,013

[45] Date of Patent: May 9, 1989

[54] MOLDING EQUIPMENT FOR THE PRODUCTION OF A CASTING MOLD

[75] Inventor: Kurt Fischer, Schaffhausen, Switzerland

[73] Assignee: Georg Fischer AG, Schaffhausen, Switzerland

[21] Appl. No.: 104,863

[22] Filed: Oct. 5, 1987

[30] Foreign Application Priority Data

Oct. 6, 1986 [CH] Switzerland ..... 03984/86

[51] Int. Cl.[4] ..... B22C 15/24

[52] U.S. Cl. ..... 164/169; 164/200; 164/239

[58] Field of Search ..... 164/169, 200, 201, 202, 164/235, 237, 239, 241, 410

[56] References Cited

U.S. PATENT DOCUMENTS

| | | | |
|---|---|---|---|
| 3,744,549 | 7/1973 | Buhler | 164/202 |
| 4,126,176 | 11/1978 | Muller et al. | 164/201 |
| 4,182,395 | 1/1980 | Buhler | 164/200 |
| 4,231,415 | 11/1980 | Wernli | 164/200 |
| 4,553,581 | 11/1985 | Uppgren et al. | 164/200 |

*Primary Examiner*—Richard K. Seidel

*Attorney, Agent, or Firm*—Bachman & LaPointe

[57] ABSTRACT

A molding appartus for use in the production of a casting mold from a granular molding material wherein the space between the pattern and the mold frame is provided with a plurality of orifices such that the sum of the area of the orifices is at least 1% the area of pattern plate between the pattern and the mold frame so as to allow for a flow through rate of air through the orifices of at least 0.005 kg/sec.

7 Claims, 1 Drawing Sheet

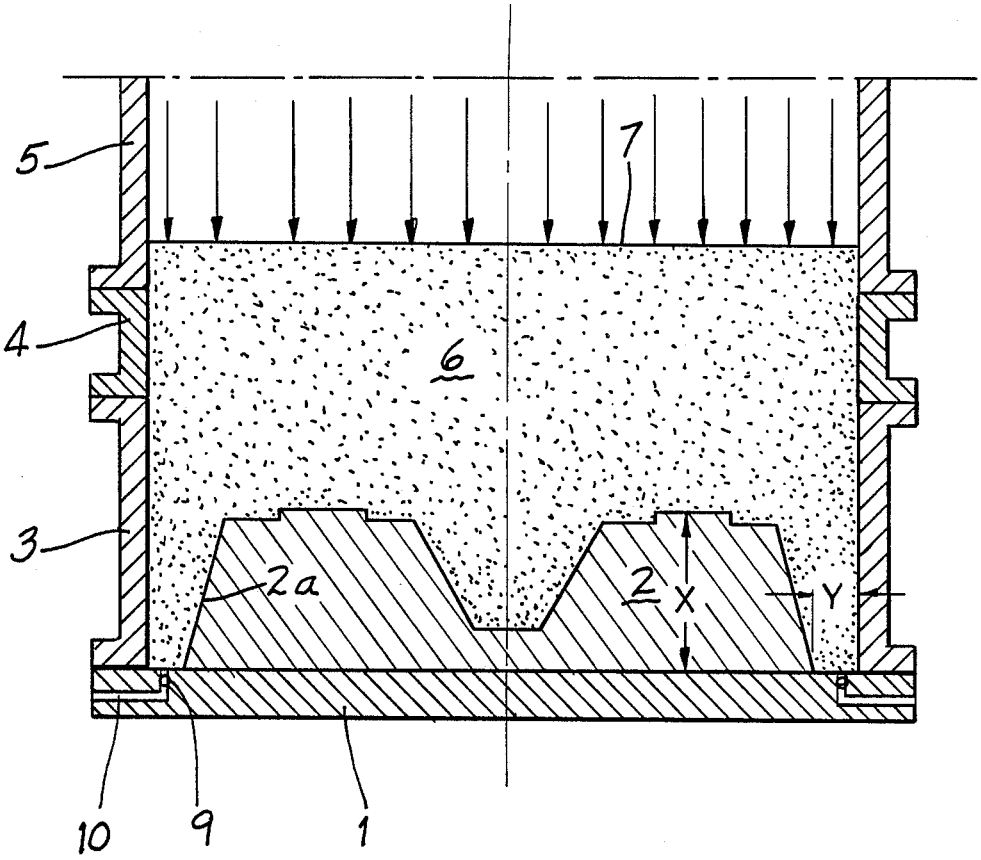
5
7
4
6
3
2a
2
X
Y
10
9
1

MOLDING EQUIPMENT FOR THE PRODUCTION OF A CASTING MOLD

BACKGROUND OF THE INVENTION

The present invention relates to a molding apparatus for use in the production of a casting mold from a granular material and, more particularly, an apparatus wherein at least one pattern is positioned on a pattern plate within a mold frame wherein the granular molding material is received in the mold frame.

The packing of granular molding materials for the purpose of producing factory molds is well-known in the prior art. German Patent Specification No. 19 61 234 discloses a process for packing granular molding material wherein the packing of the molding material is effected by the expansion of a high pressure gas within the molding apparatus. In accordance with the process of the German Specification, air is stored in a reservoir over the molding box prior to the packing of the granular material. During the packing process the air, which is stored under pressure in the reservoir, is made to act on the surface of the molding material mass to be packed in the molding box. The large mass of air supplied during the packing process flows through the granular molding material and out openings provided in the molding box. It has been found that the air used in packing the molding material is sometimes compressed in the molding material mass which results in the mold having to be scrapped. It has been found that one critical region in which this undesirable compression takes place is between the pattern and the molding box wall.

Naturally, it would be highly desirable to design a mold apparatus which allows for precise evacuation of the high pressure gas used for packing the granular molding material which would eliminate the selective compression of gas in critical regions of the molding mass material thus resulting in having to scrap the resulting mold.

Accordingly, it is the principal feature of the present invention to design a mold apparatus having an improved gas outflow pattern.

It is a particular object of the present invention to provide an outflow arrangement between the pattern and the mold box wall so as to eliminate the necessity of mold scrapping and thereby increase mold strength values.

Further objects and advantages of the present invention will appear hereinbelow.

SUMMARY OF THE INVENTION

In accordance with the present invention the foregoing objects and advantages are readily obtained.

The present invention relates to a molding apparatus for use in the production of a casting mold from a granular molding material. The molding apparatus comprises a pattern plate and a mold frame mounted on the pattern plate so as to define therewith a mold cavity. A pattern is positioned on the pattern plate within the mold cavity and spaced from the mold frame so as to define an area of pattern plate between the pattern and the mold frame. In accordance with the particular features of the present invention, a plurality of orifices are provided in the pattern plate in the area defined by the pattern and the mold frame. In accordance with the present invention, the sum of the area of the plurality of orifices is at least 1% the area of the pattern plate defined by the pattern and the mold frame thereby optimizing outflow of the gas used to compress the granular material from the molding apparatus.

In accordance with a further feature of the present invention the flow through rate of air through the plurality of orifices is at least 0.005 kg/sec thereby optimizing efficiency. In accordance with a further feature of the present invention, the pattern plate is spaced a distance of at most 50 mm from the mold frame of the molding apparatus.

A further feature of the present invention which adds to the overall improvement of the function of the apparatus of the present invention is that the ratio of the height of the pattern to the distance the pattern is spaced from the mold frame be 1:1 and, preferably, 1:0.5. By providing a molding apparatus as set forth above the disadvantages associated with known mold apparatuses are eliminated.

BRIEF DESCRIPTION OF THE DRAWING

FIG. 1 is a cross sectional view through a molding apparatus in accordance with the present invention.

DETAILED DESCRIPTION

With reference to FIG. 1, a pattern plate 2 has a mold frame 3 mounted thereon so as to define therewith a mold cavity. A pattern 2 is positioned on the pattern plate within the mold cavity and spaced from the mold frame a distance Y so as to define an area of pattern plate between the pattern and the mold frame. In accordance with the present invention the distance Y between the pattern and the mold frame is at most 50 mm and the ratio of the pattern height to the distance between the pattern and the mold frame is at least 1:1 and, preferably 1:0.5.

A filling frame 4 is seated on the mold frame and a pressure chamber, indicated by wall 5, is positioned above the filling frame. The pressure chamber serves to store air under pressure which is made to act on the molding material mass 6 within the mold cavity during the packing of the molding material.

In accordance with the present invention, a row of orifices 9 are arranged in the pattern plate in the area between the pattern and the mold frame. When the packing process is initiated using the molding apparatus of the present invention, a large volume of air is introduced into the molding material 6. In order to pack the molding material, air must be allowed to escape from the molding material. For cost effectiveness it is desirable for the pattern to occupy the greatest possible amount of the pattern plate thereby allowing smaller distances between the pattern and the mold frame. As a result, the distance between the pattern and the mold frame become smaller and smaller the result of which is that the air volume introduced into the molding material mass finds it more and more difficult to find its way into the confined regions between the pattern and the mold frame and, owing to the very fast introduction of the compressed air during the packing process, cannot always be compressed adequately. By providing the orifices 9 in the area of the pattern plate between the pattern and the mold frame, the compressed gas can be removed from the molding material mass. It has been found in accordance with the present invention that the sum of the area of the orifices should be at least 1% the area of the pattern plate between the pattern and the mold frame so that the minimum air throughput during the packing process is at least 0.005 kg/sec. The arrangement of the orifices in accordance with the present invention has the effect of preventing the air volumes enclosed in the molding material mass from being compressed during packing and thus preventing the supply of molding material to specific points. By the removal of air from these critical regions between the pattern and the mold frame, the entire region can be supplied homogeneously with molding material. This homogeneous supply of mold material is the pre-requisite for a mold of good quality.

The orifices 9 are advantageously arranged along the mold frame in the pattern plate. Distance and diameters may vary depending on the complexity of the pattern. It has been found, however, that the best effects have been achieved at a ratio of pattern height to the distance between the pattern and the mold frame of at least 1:1 and, preferably, 1:0.5.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A molding apparatus for use in the production of a casting mold from a granular molding material comprising: a pattern plate, a mold frame mounted on said pattern plate and a filling frame mounted on said mold frame such that said pattern plate, mold frame and filling frame define a mold cavity; a pattern having a maximum height X positioned on said pattern plate within said mold cavity and spaced from said mold frame a distance Y so as to define an area of pattern plate between said pattern and said mold frame wherein the ratio of X to Y is between 1:1 and 1:0.5 so as to substantially eliminate selective compression of the molding material; and a plurality of venting means in said pattern plate in said area defined by said pattern and said mold frame wherein the sum of the area of said plurality of venting means is at least 1% of said area of pattern plate defined by said pattern and said mold frame so as to allow a flow through rate of air of at least 0.005 kg/sec.

2. A mold according to claim 1 wherein said distance Y is at most 50 mm.

3. A mold according to claim 1 wherein the ratio of X to Y is 1:1.

4. A mold according to claim 1 wherein the ratio of X to Y is 1:0.5.

5. A mold according to claim 1 wherein said area of pattern plate defined by said pattern and said mold frame is continuous along said mold frame and said plurality of venting means are distributed over said area.

6. A mold according to claim 1 wherein said filling frame is free of any venting means.

7. A mold according to claim 6 wherein said mold frame is free of any venting means.

* * * * *